US009551211B2

(12) United States Patent
Gerretsen et al.

(10) Patent No.: US 9,551,211 B2
(45) Date of Patent: Jan. 24, 2017

(54) DEEPWATER LOW-RATE APPRAISAL PRODUCTION SYSTEMS

(71) Applicant: SHELL OIL COMPANY, Houston, TX (US)

(72) Inventors: Jan Hendrik Gerretsen, Houston, TX (US); Joao Paulo Juliao Matsuura, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/895,571

(22) PCT Filed: Jun. 4, 2014

(86) PCT No.: PCT/US2014/040850
§ 371 (c)(1),
(2) Date: Dec. 3, 2015

(87) PCT Pub. No.: WO2014/197559
PCT Pub. Date: Dec. 11, 2014

(65) Prior Publication Data

US 2016/0123131 A1 May 5, 2016

Related U.S. Application Data

(60) Provisional application No. 61/831,967, filed on Jun. 6, 2013.

(51) Int. Cl.

| | |
|---|---|
| ***E21B 17/01*** | (2006.01) |
| ***E21B 47/001*** | (2012.01) |
| ***E21B 47/00*** | (2012.01) |
| ***E21B 47/06*** | (2012.01) |
| ***E21B 43/01*** | (2006.01) |

(52) U.S. Cl.
CPC ..... *E21B 47/0001* (2013.01); *E21B 17/012* (2013.01); *E21B 43/0107* (2013.01); *E21B 47/06* (2013.01)

(58) Field of Classification Search
CPC E21B 17/012; E21B 43/0107; E21B 47/0001; E21B 47/06; E21B 41/0092
USPC ..... 166/350
See application file for complete search history.

(56) References Cited

U.S. PATENT DOCUMENTS

| | | | | |
|---|---|---|---|---|
| 4,892,495 | A * | 1/1990 | Svensen | B63B 21/508 114/230.12 |
| 5,878,814 | A * | 3/1999 | Breivik | B63B 22/021 166/267 |
| 6,364,021 | B1 * | 4/2002 | Coats | E21B 17/003 166/350 |
| 6,811,355 | B2 * | 11/2004 | Poldervaart | B63B 21/50 114/230.1 |
| 6,980,940 | B1 * | 12/2005 | Gurpinar | E21B 43/00 166/250.16 |
| 7,073,593 | B2 * | 7/2006 | Hatton | E21B 7/128 166/345 |
| 7,770,532 | B2 * | 8/2010 | Bauduin | B63B 21/50 114/230.2 |

(Continued)

*Primary Examiner* — Matthew R Buck

(57) ABSTRACT

A method for appraising a deepwater well comprising: producing a first quantity of hydrocarbon from an undersea reservoir; transporting the first quantity of hydrocarbon to a floating vessel; off loading the first quantity of hydrocarbon from the vessel; producing a second quantity of hydrocarbon from the undersea reservoir; and transporting the second quantity of hydrocarbon to the floating vessel.

7 Claims, 1 Drawing Sheet

(56) References Cited

U.S. PATENT DOCUMENTS

| | | | | |
|---|---|---|---|---|
| 7,793,723 | B2 * | 9/2010 | Vedeld | B63B 27/24 114/230.13 |
| 8,122,965 | B2 * | 2/2012 | Horton, III | B63B 35/003 166/336 |
| 8,141,645 | B2 * | 3/2012 | Poldervaart | B63B 27/24 166/344 |
| 8,449,341 | B2 * | 5/2013 | Denise | B63B 21/508 114/230.12 |
| 2004/0238176 | A1 * | 12/2004 | Appleford | E21B 7/128 166/353 |
| 2005/0042952 | A1 | 2/2005 | Montbarbon | |
| 2008/0138159 | A1 * | 6/2008 | Daniel | E21B 43/01 405/224.3 |
| 2014/0345299 | A1 * | 11/2014 | Kirk | E21B 43/01 62/53.2 |

* cited by examiner

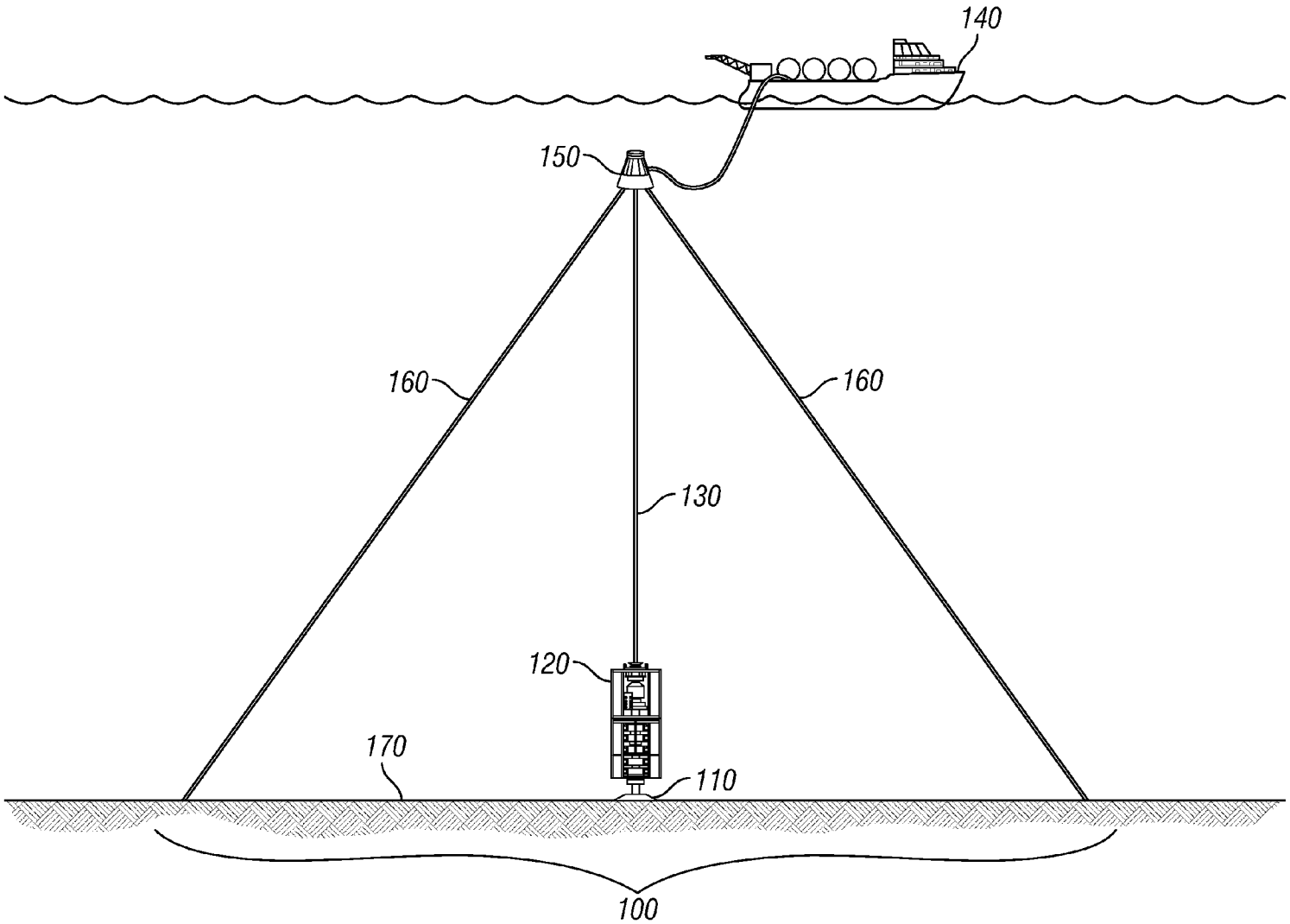
140
160
150
130
120
110
160
170
100

DEEPWATER LOW-RATE APPRAISAL PRODUCTION SYSTEMS

CROSS REFERENCE TO RELATED APPLICATIONS

This application claims the benefit of U.S. Provisional Application No. 61/831,967, filed Jun. 6, 2013, which is incorporated herein by reference.

BACKGROUND

The present disclosure relates generally to methods of appraising offshore reservoirs. More specifically, in certain embodiments the present disclosure relates to long-term, low-rate, intermittent floating hydrocarbon production systems for appraising offshore reservoirs and associated methods.

One objective of appraising recently discovered fields is to provide sufficient data so that reliable estimates of the costs, revenues, and risks associated with different field development scenarios can be made. After appraising the fields, an informed decision on how the opportunity may be best valued in the future (e.g., the selection of a field development plan, a divestment strategy, a phased development, or just holding the discovery pending nearby exploration) may be made. From a well and subsurface perspective, field appraisal aims at reducing uncertainty on the following points: the volume of hydrocarbons present, the production profile for various development scenarios, the expected initial well flow rates, the sustainable well flow rate, and the ultimate recovery per well.

Systems for appraising deepwater reservoirs typically follow one of three approaches to appraise deepwater reservoirs: (1) appraisal campaigns with multiple wells which may then be followed by short-term well tests, (2) long-term well testing, and (3) early production systems.

The first approach, while being the most common, may be the most costly due to the high drilling and completion costs. Very short term well testing (also known as drillstem well testing) is possible with this approach; however the information gathered by this approach is often limited to the vicinity of the well bore.

The second approach also tends to be costly, since it usually makes use of expensive mobile offshore drilling units to perform the well testing activity. Since the mobile offshore drilling units often do not have any significant gas storage and export capabilities, the length of time of the well test is also typically limited.

The third approach, which typically implies an oil processing rate capacity of at least 5,000 barrels a day, requires the installation of a gas export pipeline or a regulatory exemption to flare the produced gas throughout the exploitation of the reservoir by the production system. The capital cost of such a system tends to be high, especially when the gas pipeline scope is included. The alternative, long term flaring, is still costly, generally limited in terms of volumes and location, and not favorable from an environmental standpoint, restricting the usefulness of early production systems.

Low-rate well testing is relatively uncommon in deepwater developments. Such low rates may allow for an appraisal system comprised of a small floating system, with limited amounts of gas (as compressed natural gas) storage volumes, to be used intermittently. The use of such low-rate appraisal systems may be desirable because they would allow the use of intermittent floating hydrocarbon productions systems.

SUMMARY

The present disclosure relates generally to methods of appraising offshore reservoirs. More specifically, in certain embodiments the present disclosure relates to long-term, low-rate, intermittent floating hydrocarbon production systems for appraising offshore reservoirs and associated methods.

In one embodiment, the present disclosure provides a method for appraising a deepwater well comprising: producing a first quantity of hydrocarbon from an undersea reservoir to a floating vessel; exporting the first quantity of hydrocarbon from the floating vessel to an offloading vessel; and producing a second quantity of hydrocarbon from the undersea reservoir to the floating vessel.

In another embodiment, the present disclosure provides a method of appraising deepwater well comprising: connecting a floating vessel to an undersea reservoir; producing a first quantity of hydrocarbon from the undersea reservoir to the floating vessel; disconnecting the floating vessel from the undersea reservoir; offloading the first quantity of hydrocarbon from the floating vessel; reconnecting the floating vessel to the undersea reservoir; and producing a second quantity of hydrocarbon from the undersea reservoir to the floating vessel.

In another embodiment, the present disclosure provides a system comprising: a deepwater riser attached to a deepwater well; a buoy connected to the deepwater riser; and a floating vessel, wherein the floating vessel is disconnectably connected to the deepwater riser.

The features and advantages of the present disclosure will be readily apparent to those skilled in the art. While numerous changes may be made by those skilled in the art, such changes are within the spirit of the invention.

BRIEF DESCRIPTION OF THE DRAWINGS

So that the above recited features and advantages of the disclosure may be understood in detail, a more particular description of the disclosure, briefly summarized above, may be had by reference to the embodiments thereof that are illustrated in the appended drawings. It is to be noted, however, that the appended drawings illustrate only typical embodiments of this disclosure and are, therefore, not to be considered limiting of its scope. The figures are not necessarily to scale, and certain features and certain views of the figures may be shown exaggerated in scale or in schematic in the interest of clarity and conciseness.

FIG. 1 is an illustration of a deepwater low rate appraisal production system (DEL-RAPS) in accordance with the present disclosure.

DETAILED DESCRIPTION

The present disclosure relates generally to methods of appraising offshore reservoirs. More specifically, in certain embodiments the present disclosure relates to long-term, low-rate, intermittent floating hydrocarbon production systems for appraising offshore reservoirs and associated methods.

The description that follows includes exemplary apparatuses, methods, techniques, and instruction sequences that embody techniques of the inventive subject matter. However, it is understood that the described embodiments may be practiced without these specific details.

In one embodiment, the present disclosure provides a method for appraising a deepwater well comprising: producing a first quantity of hydrocarbon from an undersea reservoir to a floating vessel; exporting the first quantity of hydrocarbon from the floating vessel to an offloading vessel; and producing a second quantity of hydrocarbon from the undersea reservoir to the floating vessel.

In certain embodiments, the amount of hydrocarbon produced from the undersea reservoir may be a minimum amount. In certain embodiments, the rate of hydrocarbon produced from the undersea reservoir may be less than 5,000 barrels of oil per day and/or less than 10 MMscf of gas a day. In certain embodiments, the rate of hydrocarbon produced from the undersea reservoir may be less than 2,500 barrels of oil per day and/or less than 5 MMscf of gas per day. In other embodiments, the rate of hydrocarbon produced from the undersea reservoir may be less than 1,000 barrels per day and/or less than 2 MMscf of gas per day.

In certain embodiments, the first quantity of hydrocarbon and/or the second quantity of hydrocarbon may be from about 1,000 barrels of oil to about 50,000 barrels of oil and/or from about 2 MMscf to about 100 MMscf of gas. In other embodiments, the first quantity of hydrocarbon and/or the second quantity of hydrocarbon may be from be from about 2,000 barrels of oil to about 10,000 barrels of oil and/or from about 4 MMscf to about 20 MMscf of gas. While the individual production time of the first and/or second quantity of hydrocarbons may be from 1-10 days long, the entire production of hydrocarbon from the undersea reservoir may extend for a period of time from 1 to 18 months to allow for long-term well testing.

In certain embodiments, after the first and/or second quantities of hydrocarbon are produced, the floating vessel may disconnect from the undersea reservoir and then transport the stored hydrocarbons to an offshore or onshore facility. Once the stored hydrocarbons are offloaded, the floating vessel may then return to the field and reconnect to the well to continue production testing. In certain embodiments, the first and/or second quantities of hydrocarbon are exported from the vessel to an offloading vessel for onshore sales In certain embodiments, the first quantity and/or the second quantity of hydrocarbons may be produced to the floating vessel via a deepwater redeployable riser. The deepwater re-deployable riser may be attached to a moored buoy which may be disconnectably attached to the floating vessel. When producing the first and second quantities of hydrocarbon from the undersea reservoir to the floating vessel, the deepwater riser may be attached to both the moored buoy and the floating vessel. When offloading the first and second quantities of hydrocarbon from the floating vessel, the deepwater riser may be attached to the moored buoy and not the floating vessel.

The floating vessel may be a floating vessel with a gas storage capability. In certain embodiments, the floating vessel includes means to produce and store relatively small amounts of oil, oily water, and gas, the latter in the form of compressed natural gas (CNG), or liquefied natural gas (LNG), or via conversion to liquids (known as GTL, or gas-to-liquids), or via storage of natural gas in hydrate form. Natural gas can also be consumed for the provision of power to the floating vessel. In certain embodiments, the floating vessel may be capable of storing up to 100 MMscf of gas. Benefits of including such storage means may include the circumvention of the need for costly and time-consuming installation of gas export pipelines.

In certain embodiments, the method may further comprise measuring pressure and temperature changes downhole, close to the producing zones and/or elsewhere in the subsurface, while producing the hydrocarbons from the reservoir. Measuring the pressure differences allows one to estimate reservoir volumes in place, connectivity, and aquifer strength, among other reservoir parameters that are of importance when appraising reservoirs for further development. By using these minimum oil production rates, this method enables the cost-effective, longer-term gathering of reservoir data from one or more offshore wells, extending the effective radius from which information is gathered. Utilizing such rates, may enable the production of the first and/or second quantity of hydrocarbon to last for multiple months before the floating vessel needs to be offloaded.

In another embodiment, the present disclosure provides a method of appraising deepwater well comprising: connecting a floating vessel to an undersea reservoir; producing a first quantity of hydrocarbon from the undersea reservoir to the floating vessel; disconnecting the floating vessel from the undersea reservoir; off loading the first quantity of hydrocarbon from the floating vessel; reconnecting the floating vessel to the undersea reservoir; producing a second quantity of hydrocarbon from the undersea reservoir to the floating vessel.

In another embodiment, the present disclosure provides a system for appraising a deepwater well comprising: a deepwater riser attached to a deepwater well; a buoy connected to the deepwater riser; and a floating vessel disconnectably attached to the deepwater riser.

An example of such an embodiment is illustrated in FIG. 1. FIG. 1 illustrates a deepwater low rate appraisal production system 100 comprising well site 110, subsea tree 120, riser 130, vessel 140, and buoy 150. As can be seen in FIG. 1, the riser 130 may be connected to a subsea tree 120 of well site 110 and also connected to buoy 150. Buoy 150 may be moored by one or more mooring lines 160 to subsea floor 170. Vessel 140 may be disconnectably attached to riser 130.

To facilitate a better understanding of the present invention, the following examples of specific embodiments are given. In no way should the following examples be read to limit, or to define, the scope of the invention.

EXAMPLES

The applicability of DEL-RAPS system to four main dynamic tests was investigated. In these investigations, the system was assumed to have the following specifications: an oil production system with no upper limit on the oil production rate, an oil storage capacity of 28,000 bbls, a gas storage capacity compatible with the oil storage capacity, and offloading the produced fluids requires to disconnect DEL-RAPS from the well resulting in a 2 days production shut-down

Example 1

Short Term Production Tests

The applicability of DEL-RAPS for short term tests was evaluated. Because DEL-RAPS allows for low to high production rates, it may be a very flexible system capable of performing short term production tests (e.g. step rate tests). However, the limited storage capacity may be a constraint if a well needs to be produced at very high rates. In such cases, the test may be divided in shorter tests to offload the stored fluids between two high production rate periods. Since there was no major difference between the data collected with DEL-RAPS during a short production test and the data that is commonly gathered from traditional systems (e.g. from the rig), it was concluded that DEL-RAPS system was equivalent to other systems for this purpose and therefore adequate to conduct short term production tests.

Example 2

Long Term Production Tests

The applicability of DEL-RAPS to long production tests was investigated through reservoir simulation. In the simulations, the bottom hole and field pressure changes resulting from the application of a system having the assumed DEL-RAPS specifications were compared for various subsurface scenarios. The scenarios were selected such that they represented a realistic subsurface uncertainty range as encountered in actual field appraisals.

The first reservoir model mimicked the application of DEL-RAPS to a large reservoir. The STOIIP uncertainty for this reservoir was assumed to be 1.5 Bbbls. The second model corresponded to a medium size reservoir application with a STOIIP of 500 MMbbls. The last model represented a small reservoir (to deepwater standards), with a STOIIP of 100 MMbbls.

For all the performed simulations, the production was cyclic, 7 days on followed by 2 days off, over a 1 year period. When a simulation was completed, the pressure profile generated for the last build-up was extracted for comparison to other simulations corresponding to different subsurface scenarios.

The simulations indicated that the DEL-RAPS production rate and cyclic operations allow the generation of different bottom hole pressure responses for the various geological scenarios. The differences were generally large enough (often a few psi to a few tens of psi) to be clearly distinguished by modern downhole pressure gauges.

It is also observed that changing the flow rate only affected the amplitude of the pressure differences but did not affect the relative positions of the simulated curves. It therefore appeared that higher flow rates did not lead to additional reservoir information or to an elimination of some of the ambiguities (i.e. there was no clear benefit of generating larger pressure differences with higher rates).

All tests demonstrated that a noticeable pressure difference between the various scenarios might occur much before the 1 year duration used in the simulations. Depending on the reservoir conditions, the duration of the test could be much shorter (a few weeks or months) or longer (several years). The presented simulations demonstrated that valuable data can be generated from a DEL-RAPS long production test.

From the above, it is concluded that the reservoir information that can be derived from the bottom hole pressure data collected from a long production test was similar at low or high flow rates. In most cases achieving a large enough pressure difference between the various possible geological scenarios should be possible using DEL-RAPS.

In all the simulated cases, DEL-RAPS was be able to generate noticeable reservoir pressure changes at large distances from the tested producing well and within a reasonable time frame. The higher rates that could be achieved with alternative systems did not seem to provide additional benefits apart from being able to reach the same pressure effect sooner.

Example 3

Transient Build-Up Well Tests

The applicability of DEL-RAPS to pressure transient build-up well tests was evaluated. Because DEL-RAPS may operate as a long term low rate system or as a short term high rate one, it was important to verify that the pressure signal generated under those conditions could be used for pressure transient analysis.

Well test models corresponding to five sets of reservoir conditions representing a large range of situations were constructed. The models assumed the presence of a single fault located at 300 m or 1000 m from a vertical well. Based on the results of the previous section, noise levels of 0 psi, 0.1 psi and 0.5 psi were assumed.

Comparisons between the well test data that would be generated with DEL-RAPS and the well test data from a system that is not capacity limited (for instance from the rig) were made.

A base case reservoir condition was used to conduct a detailed investigation of the differences between a traditional well test and a well test performed with DEL-RAPS. First, two simple models corresponding to pressure build-ups following a 7 days flow period at 15000 bod and at 4000 bod were constructed. Since the calculation was fundamentally based on the basic flow equations, the two pressure profiles were proportional when no noise is incorporated in the models. In practice, the two pressure profiles, and similarly their derivative profiles, may be vertically shifted on a log-log scale.

Increasing the duration of the production with a series of production/shut-in cycles such as the ones that can be performed from DEL-RAPS did not appear to help clarifying the data. However, increasing the flow rate while reducing the production duration (remaining within the DEL-RAPS storage capacity) did significantly reduce noise on the derivative (i.e. applying the high rate/short production duration strategy (a ~15000 bod leads to a ~6000 psi drawdown)). This high rate/short production duration solution may also applicable to cases where the presence of flow barriers located far from the well need to be detected if the noise level is not too large.

The well test modeling demonstrated that DEL-RAPS could be applied as a viable well testing system. Its capabilities would be equivalent to traditional well testing methodologies (e.g. from the rig) in most situations. However, when the reservoir conditions are not favorable to low rate well testing, i.e. when permeability is high or viscosity is low resulting in small drawdowns at low rate, a high level of noise in the data could be more difficult to handle with DEL-RAPS than with traditional systems where a prolonged high flow rate is possible. With such reservoir conditions, one approach is to flow the well at high rate for a short duration (remaining within the DEL-RAPS storage capacity) before proceeding with the build-up. With this strategy, the capability to accurately measure the flow rate on a well that is quickly ramped-up and not producing at stable conditions would be required. Using such a short term high production rate flow period preceding a build-up is a change to current practices.

Example 4

Pressure Transient Interference Tests

In this example, a pressure change of 0.1 psi was considered to be the minimum required to establish reservoir connectivity and eventually perform an interference test analysis. It was believed that even in the presence of a 0.1 psi noise, a 0.1 psi pressure change should remain detectable as demonstrated by the tidal effect observed on build-up data.

Pressure equations presented were used to compute pressure profiles as a function of the distance from a well that is assumed to flow at a constant rate. The reservoir was assumed to have no flow boundaries. The flow towards the well was purely radial.

At any given time, the reservoir pressure was strongly dependent on the reservoir rock and fluid properties. As an example, a comparison of the expected pressure profiles after 7 days of production at 4000 bod demonstrated that the pressure was very different for the different sets of reservoir conditions.

To complement the 7 day/4000 bod scenario, the theoretical pressure profiles for three additional flow scenarios were computed: a 1 day/28000 bod, a 56 day/500 bod, and a 280 day/100 bod. For all the scenarios, the cumulative produced volume was consistent with the assumed storage capacity of the system (28000 bbls).

The distance where the pressure change was greater than 0.1 psi was estimated for the 4 flow scenarios and 5 reservoir conditions. The results indicated that large reservoirs (thick, high porosity), were the most problematic when performing an interference test as raising reservoir pressure required a high production volume in these reservoirs.

The models indicated that a test design approach consisting in combining either a low rate with a long term production or a high rate with short term production could be used to generate pressure changes of at least 0.1 psi at large distances from the tested well (1500 m or more). As such DEL-RAPS could be used as a viable technology to establish reservoir connectivity and possibly derive valuable information such as the reservoir permeability in the area located between the source and observation wells.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A method for appraising a deepwater well comprising:

producing a first quantity of hydrocarbon from an undersea reservoir to a floating vessel at a rate of less than 1000 barrels of oil per day while measuring pressure changes in the undersea reservoir, wherein the first quantity of hydrocarbon is less than 10,000 barrels of oil;

offloading the first quantity of hydrocarbon from the floating vessel;

producing a second quantity of hydrocarbon from the undersea reservoir to the floating vessel at a rate of less than 1000 barrels of oil per day while measuring pressure changes in the undersea reservoir; and estimating reservoir parameters based upon the measured pressure changes while producing the first and second quantities of hydrocarbon, wherein the reservoir parameters comprise reservoir volumes in place, connectivity, and aquifer strength.

2. The method of claim 1, wherein the floating vessel comprises a floating vessel with a gas storage capability.

3. The method of claim 1, wherein the floating vessel is connected to the undersea reservoir via a redeployable riser while producing the first and second quantities of hydrocarbon.

4. The method of claim 3, wherein the redeployable riser is connected to a moored buoy.

5. A method of appraising deepwater well comprising:

connecting a floating vessel to an undersea reservoir;

producing a first quantity of hydrocarbon from the undersea reservoir to the floating vessel at a rate of less than 1000 barrels of oil per day while measuring pressure changes in the undersea reservoir, wherein the first quantity of hydrocarbon is less than 10,000 barrels of oil;

disconnecting the floating vessel from the undersea reservoir;

offloading the first quantity of hydrocarbon from the floating vessel;

reconnecting the floating vessel to the undersea reservoir;

producing a second quantity of hydrocarbon from the undersea reservoir to the floating vessel at a rate of less than 1000 barrels of oil per day while measuring pressure changes in the undersea reservoir; and estimating reservoir parameters based upon the measured pressure changes while producing the first and second quantities of hydrocarbon, wherein the reservoir parameters comprise reservoir volumes in place, connectivity, and aquifer strength.

6. The method of claim 5, wherein the floating vessel comprises a floating vessel with a gas storage capability.

7. The method of claim 5, wherein connecting the floating vessel to the undersea reservoir comprises connecting the floating vessel to a redeployable riser that is connected to the undersea reservoir, disconnecting the floating vessel from the undersea reservoir comprises disconnecting the floating vessel from the redeployable riser, and reconnecting the floating vessel to the undersea reservoir comprises reconnecting the floating vessel to the redeployable riser.

* * * * *